United States Patent [19]

Spronken

[11] Patent Number: 4,898,358

[45] Date of Patent: Feb. 6, 1990

[54] FORM-WORK FOR CONCRETE

[76] Inventor: John R. Spronken, Suite 103, 1400 Kensington Road, N.W., Calgary, Alberta T2N 3P9, Canada

[21] Appl. No.: 277,253

[22] Filed: Nov. 29, 1988

[51] Int. Cl.[4] ..... E01C 7/00

[52] U.S. Cl. ..... 249/7; 249/208; 249/219.1; 404/47; 404/87

[58] Field of Search ..... 249/2, 3, 4, 5, 6, 7, 249/8, 9, 208, 219.1; 404/47, 48, 87

[56] References Cited

U.S. PATENT DOCUMENTS

| | | | |
|---|---|---|---|
| Re. 16,694 | 8/1927 | Heltzel | 249/7 |
| 1,032,875 | 7/1912 | Braine | 249/6 |
| 1,348,060 | 7/1920 | Sheppard | 249/7 |
| 1,690,295 | 11/1928 | Heltzel | 249/6 |
| 2,138,634 | 11/1938 | Harrington | 25/118 |
| 2,577,996 | 12/1951 | Braun | 25/118 |
| 2,875,500 | 3/1959 | Stough | 25/118 |
| 2,937,430 | 5/1960 | Trentacosti | 25/118 |
| 3,910,545 | 10/1975 | Langford | 249/7 |
| 4,340,200 | 7/1982 | Stegmeier | 249/3 |

*Primary Examiner*—Jay H. Woo
*Assistant Examiner*—K. P. Nguyen

[57] ABSTRACT

Concrete form-work includes: (a) an edge beam including an elongated edge plate having a front face and a rear face, a pair of web portions projecting outwardly from said rear face and a flange member joined to the free end of each web portion, each flange member including a plate portion extending outwardly of said web and substantially parallel to said edge plate and a lip portion extending inwardly of the web, (b) a pair of connector members each comprising a plate with a hole for receiving a stake, an off-set wedge-receiving flange at one edge of the plate and a connector flange at the opposite edge of the plate, said connector flange including a J-shaped hook portion for hooking around a said edge beam flange lip and an abutment face for engaging a stake and (c) a wedge member adapted to engage the off-set flanges of said connector member to hold the connector member and force the connector member abutment faces into tight engagement with a stake.

9 Claims, 2 Drawing Sheets

FORM-WORK FOR CONCRETE

BACKGROUND OF THE INVENTION

This invention relates to form-work of the kind used for the construction of concrete decks, roadways, sidewalks, etc.

Poured concrete structures formed along the surface of the ground, such as concrete decks, roadways, sidewalks, etc. are typically constructed by preparing a firm bed upon which the deck is to rest. Border defining forms are provided for confining the uncured concrete mixture to a desired border contour, which may be straight or curved. A concrete mixture is poured over the prepared bed to fill the form and the surface of the poured concrete is trowled. After the concrete has cured, the forms are removed.

Two types of form-work are typically used for constructing concrete decks, namely structures of wood formed of boards and stakes fastened by nails and structures of specially formed metal form boards and stakes held together by rigid metal wedges. The wood form-work structures are typically constructed by driving stakes into the ground at intervals along a stake line that follows the desired edge contour of the deck. Then, boards are placed against the stakes and are nailed thereto. Usually, the stakes are displaced by the force of nailing, making it virtually impossible to locate the edge board at the precisely desired location. Moreover, the edge boards tend to break while being dismantled and they typically have a very low number of repeated uses.

The metal type form-work structures have been known for a number of years and typically include a metal formboard with connector means for connecting to stakes. One such device is described in Langford, U.S. Pat. No. 3,910,545, issued Oct. 7, 1975. In this design a steel wedge is driven through a projecting flange of an edge plate. The repeated wedging of the stake within the flange causes gauling of the stakes and/or the flanges. As a consequence, the accuracy of the system deteriorates with use.

Another type of metal form-work is described in Stegmeier, U.S. Pat. No. 4,340,200 issued July 20, 1982. In that design, a spring clip arrangement is utilized which hooks around the edges of the edge plate of the form-work. A stake passes through the clip member. However, this system does not provide a solid wedging system and relies on a spring clip for the accuracy of location. This spring clip assembly is both difficult to manufacture and difficult to use.

SUMMARY OF THE INVENTION

According to the present invention a new type of metal form-work has been developed which substantially overcomes the deficiencies of the above systems. A main component of the form-work system of this invention is an edge beam which includes an elongated edge plate having a front face and a rear face. A pair of web portions project outwardly from the rear face and a flange member is joined to the free end of each of these web portions. Each flange member includes a plate portion extending outwardly of the web and substantially parallel to the edge plate and a lip portion extending inwardly of the web. A pair of connector members are provided for connecting to the lip portions of the flanges. Each of these connector members comprises a plate with a hole for receiving a stake, an offset portion at one edge of the plate for receiving a wedge member and a connector flange at the opposite edge of the plate, which connector flange includes a J-shaped hook portion for hooking around the flange lip of the edge beam. An abutment face is also provided on the connector flange for engaging a stake. Finally, a wedge member is provided which is adapted to engage the offset flanges of the connector member such as to hold the connector members together and force the connector member abutment faces into tight engagement with a stake passing through the holes.

Since the stakes are wedged between flat faces, there are few wear problems and the wedge members can easily be driven back out of the assembly when the concrete deck has cured.

The edge beam itself is an important part of the present invention and has numerous advantages. Thus, the web portions typically have a width of about 1 to 6 inches. Beams with the wide web portions are very strong and rigid structures which can be used for long straight lengths of form-work while permitting the stakes to be widely spaced. The narrower web portions permit easy shaping of the edge beam into various curved sections such as may typically be used for a deck surrounding a swimming pool.

The combination of the edge plate and the parallel flange member at the opposite end of the web portion has the advantage of providing a convenient means for supporting either straight or curved vertical extensions to the height of the edge plate.

BRIEF DESCRIPTION OF THE DRAWINGS

The foregoing as well as other features and advantages of the apparatus of the present invention will become more apparent upon a consideration of the following detailed description and claims together with the accompanying drawings in which:

DESCRIPTION OF THE PREFERRED EMBODIMENT

Figure 1:
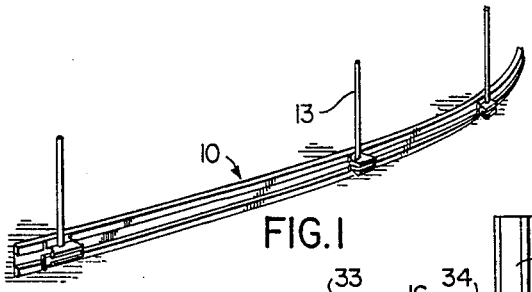
FIG. 1 is a perspective view of a portion of form-work for constructing a concrete deck structure.

FIG. 1 shows the form-work of the present invention assembled for a curving section of form-work. It includes the edge beam 10 supported by stakes 13 via hook connectors 18 and wedges 29.

Figure 2:
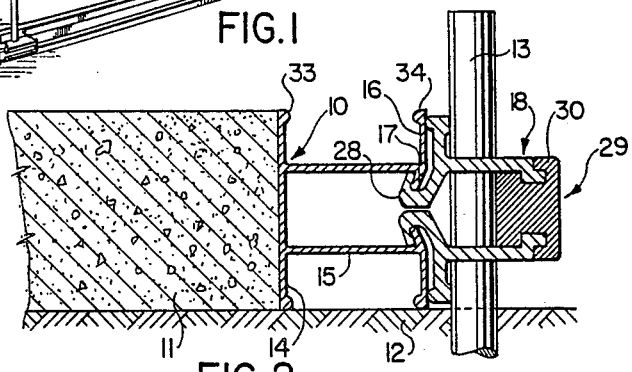
FIG. 2 is a sectional view of the assembled device of the invention.
Figure 3:
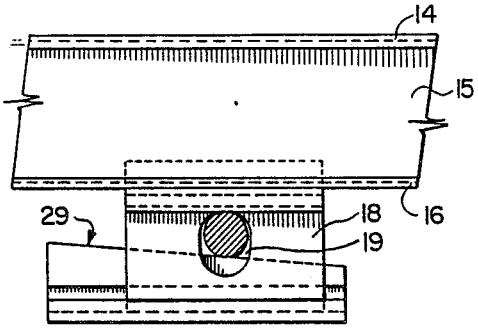
FIG. 3 is a top plan view of the arrangement shown in FIG. 2.
Figure 4:
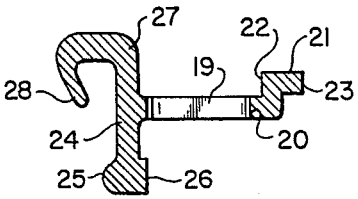
FIG. 4 is a sectional view of a connector member.

Looking at the details of the assembly in FIGS. 2 and 3, it will be seen that the edge beam 10 includes a vertical plate portion 14 with web portions 15 extending outwardly from the rear face thereof. The free ends of the web portions 15 include flange members, each having a plate portion 16 substantially parallel to edge plate 14 and a lip portion 17 extending inwardly of the web 15. The edges of the plates 14 and 16 may include a bead or rounded projection 33 and 34 respectively.

For assembly, the edge beam 10 is placed on the ground 12 as shown in FIG. 2 and two connector hook members 18 are hooked to the lips 17. Each one of these connector hook members 18 includes a flat main body portion 20 with a stake-receiving hole 19 extending therethrough. The outer end of main body portion 20 includes an offset portion 21 providing an inwardly directed face portion 22 perpendicular to main body portion 20 and an outer face 23 parallel to the inner face 22.

The other end of the main body portion 20 includes a flange member 24 perpendicular thereto, this flange having at one end thereof a rounded projection or bead 25 and opposite thereto a flat abutment face 26. The other end of flange 24 includes an arm portion 27 with a hook 28. This hook 28 is designed to firmly catch against the inner edge of lip 17 of the edge beam 10.

With the connector plates 18 slipped over a stake 13 and hook portions 28 hooked around lips 17, wedge member 29 is slid over the offset portions 21 of the connector plates 18.

Figure 5:
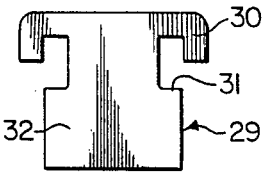
FIG. 5 is a sectional view of a wedge member.
Figure 6:
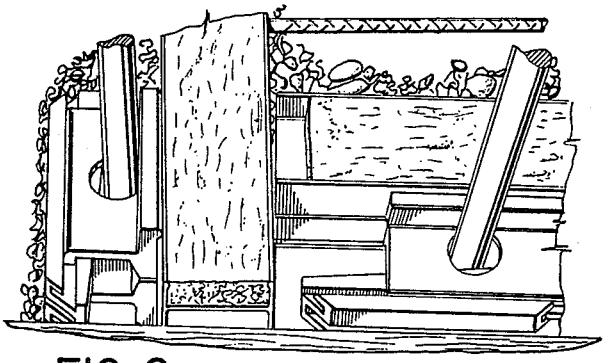
FIG. 6 is a perspective view of a corner assembly according to the invention.

As can be seen from FIG. 5, the wedge 29 includes a main body portion 32, a pair of arm member 30 for hooking around the connector plate offset portions 21 and a tapering slide face 31 which provides the wedging action. Thus, the wedging face 31 is driven along the edge face 22 of offset portion 21 until the entire assembly is rigid. Thus, as can be seen from FIG. 3, the stake 13 is forced firmly against the abutment faces 26, while the hooks 28 firmly hold the edge beam 10 in place. The assembly is then ready for pouring a concrete deck 11.

Figure 7:
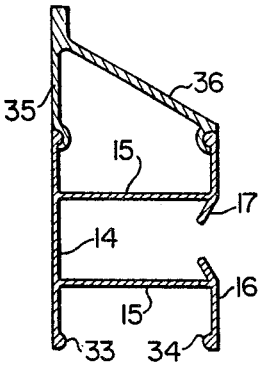
FIG. 7 is a sectional view of an edge beam with a straight extension.

An edge beam with relatively wide web portions 15 is shown in FIG. 7. This includes a vertical extension 35 for edge plate 14. The extension is held in place by means of a hook portion 40 which hooks around the bead 33 of plate 14 and an angle brace 36 with a hook portion 41 which hooks around bead 34 of flange 16. This can easily be snapped in place.

Figure 8:
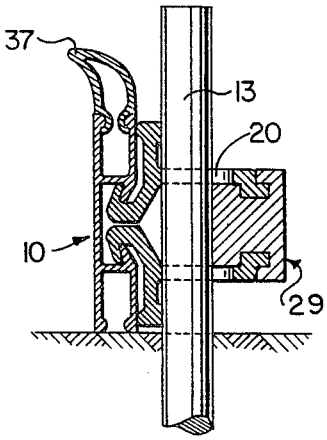
FIG. 8 is a sectional view of an edge beam with a rounded projection.

Another form of snap in extension is shown in FIG. 8 which has particular application for edge beams with a relatively narrow web portion. In this case a rounded extension 37 is formed having a pair of hooked portions 42 which snap in between the beads 33 and 34.

Figure 9:
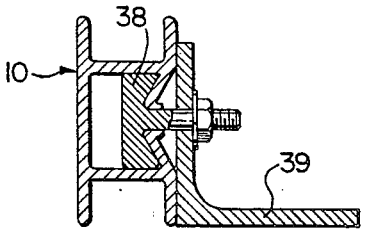
FIG. 9 is an edge beam with an alternative connector.

Another mode of utilizing the edge beam 10 is shown in FIG. 9. Here, a T-bolt 38 has been placed within the lips 17 and this can then be used for bolting any structural component, e.g. angle brace 39, to the inner face of the edge beam 10.

The edge beam, connector plates 18 and wedge members 29 can all be conveniently be extruded aluminum parts. This means that they are light, easy to store and easy to use.

Although the invention has been described in connection with preferred embodiment thereof, it will be appreciated by those skilled in the art that various changes and modifications can be made without departing from the spirit of the invention. Therefore, it is intended that the coverage of the invention be limited only by the language of the claims and its equivalent.

What is claimed is:

1. Concrete form-work which comprises:

(a) an edge beam comprising an elongated edge plate having a front face and a rear face, a pair of web portions projecting outwardly from said rear face with a vertical space therebetween and a flange member joined to the free end of each web portion, each flange member including a plate portion extending outwardly relative to the vertical space between the web portion and substantially parallel to said edge plate and a lip portion extending inwardly into said vertical space, (b) a pair of connector members each comprising a plate with a hole for receiving a stake, an off-set wedge-receiving flange at one edge of the plate and a connector flange at the opposite edge of the plate, each said connector flange including a J-shaped hook portion for hooking around each said edge beam flange lip and an abutment face for engaging a stake and (c) a wedge member for engaging the off-set flanges of said pair of connector members to hold the connector members and force the connector member abutment faces into tight engagement with the stake.

2. The apparatus of claim 1 wherein said lip portion slopes inwardly toward the edge plate.

3. The apparatus of claim 1 wherein said web portions have a depth of about 1 to 6 inches.

4. The apparatus of claim 1 wherein the edge plate has a bead projecting from at least one of the top and bottom edges of the rear face thereof.

5. The apparatus of claim 4 wherein at least one of said flange members at the outer edge thereof a bead portion projecting inwardly toward said edge plate.

6. The apparatus of claim 5 which includes a vertical extension to the edge plate adapted to be held in position by a snap-fit over the edge plate and flange beads.

7. The apparatus of claim 1 which includes at least one T-bolt with the head thereof held between the lip portions of the edge plate and an outwardly projecting threaded portion.

8. The apparatus of claim 1 wherein the abutment face is a flat face.

9. The apparatus of claim 1 wherein the wedge member is a solid cast member having slots to slidably receive and retain the off-set flanges.

* * * * *